US011219808B2

(12) United States Patent
Valdeus

(10) Patent No.: US 11,219,808 B2
(45) Date of Patent: Jan. 11, 2022

(54) SYSTEM FOR TEAM BALL GAME HAVING INTERACTIVE GOAL BARRIERS

(71) Applicant: Fritz J Valdeus, Palm Beach Gardens, FL (US)

(72) Inventor: Fritz J Valdeus, Palm Beach Gardens, FL (US)

( * ) Notice: Subject to any disclaimer, the term of this patent is extended or adjusted under 35 U.S.C. 154(b) by 0 days.

(21) Appl. No.: 16/852,504

(22) Filed: Apr. 19, 2020

(65) Prior Publication Data

US 2020/0330842 A1 Oct. 22, 2020

Related U.S. Application Data

(60) Provisional application No. 62/836,281, filed on Apr. 19, 2019.

(51) Int. Cl.
*A63C 19/00* (2006.01)
*A63B 67/06* (2006.01)

(52) U.S. Cl.
CPC ..... *A63B 67/06* (2013.01); *A63C 19/00* (2013.01); *A63B 2067/061* (2013.01); *A63B 2225/50* (2013.01)

(58) Field of Classification Search
CPC ..... A63B 37/14; A63B 63/00; A63B 67/06; A63B 69/0097; A63C 19/00; A63C 19/02; E01F 13/00–126; E01F 13/022
USPC ..... D21/699, 706; D25/38.1
See application file for complete search history.

(56) References Cited

U.S. PATENT DOCUMENTS 4,260,154 A * 4/1981 Balbastro ..... A63B 67/002 473/472
4,570,931 A * 2/1986 Martin ..... A63B 39/06 473/596
4,717,156 A * 1/1988 Wright ..... A63B 67/06 273/401

(Continued)

FOREIGN PATENT DOCUMENTS

WO WO-2008071148 A1 * 6/2008 ..... A63C 19/08
WO 2009008995 A1 1/2009

OTHER PUBLICATIONS

English machine translation of Munk, WO 2008/071148 A1 (Year: 2008).*

(Continued)

*Primary Examiner* — Laura Davison
(74) *Attorney, Agent, or Firm* — Allen F. Bennett; Bennett Intellectual Property

(57) ABSTRACT

Systems and devices for a team game played on an obround court includes radially symmetric barriers defining cylindrical goals having circular openings concentric with the semicircles of the obround court. An annular halt zone extends around the barriers. A free throw line extends around each halt zone. An obround judge lane extends along the perimeter of the court and is occupied by two judges or referees that monitor the game, while another judge or referee remains inside the perimeter. The court is divided by a centerline which includes a circle at the center of the court. The outer wall of the barrier includes one or more video screens. Audience members can access a computer network to display images, text or video selected by them in real-time during gameplay. The ball used for the game has a surface texture provided by a plurality of square pebbles instead of rounded pebbles.

1 Claim, 6 Drawing Sheets

(56) References Cited

U.S. PATENT DOCUMENTS

| | | | | |
|---|---|---|---|---|
| 4,911,443 | A | 3/1990 | Foster | |
| 5,104,255 | A * | 4/1992 | Bodensohn | E01F 15/086 404/7 |
| 5,257,808 | A * | 11/1993 | Mueller | A63B 69/3623 473/174 |
| 5,312,109 | A * | 5/1994 | Cagle | A63C 19/00 473/446 |
| 5,820,470 | A * | 10/1998 | Saunders | A63C 19/00 472/92 |
| 6,086,285 | A * | 7/2000 | Christensen | E01F 13/022 256/1 |
| 6,213,900 | B1 | 4/2001 | Steyn et al. | |
| 6,394,918 | B1 * | 5/2002 | Erhard | A63C 19/06 472/92 |
| 6,676,546 | B2 * | 1/2004 | Gordon | A63B 5/11 473/415 |
| 6,849,010 | B1 | 2/2005 | Valdeus | |
| 7,311,617 | B2 * | 12/2007 | Langhorn | A63B 63/00 473/446 |
| 8,506,370 | B2 * | 8/2013 | Homsi | A63B 24/0084 463/2 |
| 9,242,157 | B2 | 1/2016 | Piccolo | |
| 9,415,292 | B2 * | 8/2016 | Reino | A63B 57/00 |
| 9,421,457 | B2 * | 8/2016 | Faratzis | A63F 13/31 |
| D808,485 | S | 1/2018 | Czane | |
| 9,943,745 | B2 * | 4/2018 | Welck | A63B 71/0619 |
| 10,112,076 | B2 * | 10/2018 | DeCarlo | G06N 5/022 |
| 10,653,938 | B1 * | 5/2020 | Traustason | A63B 69/0053 |
| 2004/0127312 | A1 | 7/2004 | Guenther et al. | |
| 2004/0132558 | A1 * | 7/2004 | Rothman | A63B 71/022 473/434 |
| 2004/0171381 | A1 * | 9/2004 | Inselberg | H04H 20/38 455/426.2 |
| 2004/0214666 | A1 * | 10/2004 | Dilling | A63B 63/00 473/470 |
| 2007/0021241 | A1 | 1/2007 | Geller et al. | |
| 2007/0187897 | A1 | 8/2007 | Dilling | |
| 2008/0150236 | A1 | 6/2008 | Akhndov | |
| 2009/0069123 | A1 * | 3/2009 | Nugent | A63B 71/0619 473/422 |
| 2009/0227398 | A1 | 9/2009 | Gibson | |
| 2010/0210380 | A1 | 8/2010 | Cerpok | |
| 2011/0195806 | A1 | 8/2011 | Perez | |
| 2012/0157245 | A1 | 6/2012 | Narsimhan | |
| 2014/0235374 | A1 | 8/2014 | Armell | |
| 2016/0136497 | A1 | 5/2016 | Grou | |
| 2021/0092335 | A1 * | 3/2021 | Cramer | G03B 21/10 |

OTHER PUBLICATIONS

Greenpointers, "McCarren Park Track Reopens Following Improvements", Jan. 29, 2019, https://greenpointers.com/2019/01/29/mccarren-park-track-reopens-following-improvements (Year: 2019).*

* cited by examiner

ISO TOP VIEW

SYSTEM FOR TEAM BALL GAME HAVING INTERACTIVE GOAL BARRIERS

BACKGROUND OF THE INVENTION

Field of the Invention

The present invention relates to a team sport having a goal surrounded by a display screen and incorporating a ball having square pebbling.

Description of the Related Art

The concepts of both indoor and outdoor playing fields or courts is known in soccer, basketball, football, hockey, and the like. Each sport has different needs for the type of surface and enclosure to play the sport. Games such as hockey, soccer and basketball have grown in public appeal over the years as the general public's enthusiasm has increased for fast paced, exciting games. A brief discussion of several patents and a patent application publication pertaining to different types of playing areas will now follow:

Rothman—Patent Application Publication Number US2004/0132558 A1 describes a training aid for a soccer player to rebound a soccer ball off of nets, each capable of having a different orientation in a different plane. The player stands within an enclosure of four nets and practices repeatedly kicking the ball into any one of the nets to increase the players skill in rebounding a ball and ball handling.

Cagle—U.S. Pat. No. 5,312,109 describes a training court for soccer players. The court is about the size of a tennis court. An actual soccer field measures 120 yards by 75 yards, therefore, the Cagle court is substantially smaller than a standard soccer field.

Saunders—U.S. Pat. No. 5,820,470 describes a portable modular playing area that, according to the inventor, can be utilized for ice skating, ice hockey, in-line skating, ball hockey, basketball or in-door arena style soccer.

Erhard—U.S. Pat. No. 6,394,918 B1 describes a playing-field enclosure having individual band elements joined to each other by connecting elements. Net-holding pins are inserted into a connecting rib. The net-holding pins secure a net.

Balbastro—U.S. Pat. No. 4,260,154 describes a method of playing a ball game in which the ball is moved around the playing surface by only using the sides of a players feet. A player scores a goal by successfully shooting a goal from a designated goal shooting area into an elevated goal.

Gordon—U.S. Pat. No. 6,676,546 B2 describes a game court and a method for playing a game that is similar to basketball, but has several differences and has adjacent surface areas with distinctly different properties.

Audience participation is considered important for increasing popularity of a game. Therefore, audiences typically perform several functions during game play, such as cheering, chanting, "doing the wave," and more recently appearing on a JumboTron®. However, these remain passive methods of participation. It would therefore be desirable to provide methods to increase audience participation in a game.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

BRIEF SUMMARY OF THE INVENTION

Disclosed is a court design and devices for use in the playing of a game that preferably involves a substantially level and smooth playing area, a ball and a goal area. The game may serve to challenge and improve a person's dexterity, precision of motions, cardiovascular health, balance, and strategic planning of next moves. The present invention is novel and distinct, since it may be played outdoors or indoors, irrespective of the type or size of the playing surface.

In one embodiment, A team ball game system having interactive goal barriers has an obround court defined by a court perimeter formed from two semicircles connected by two parallel lines tangent to opposing endpoints of the semicircles. Each semicircle defines a centerpoint equidistant from every point of the semicircle defining it. An obround judge lane extends about the perimeter of the obround court and having a constant width defined by the court perimeter and a judge lane perimeter. Two cylindrical barriers are placed on the court, each being concentric to one of the semicircles of the perimeter. The barriers define two goals as the cylindrical space inside the cylindrical barriers. Each goal has a circular opening defined by an upper rim of each of the barriers. Two annular halt zones are located on the court, each concentric to and extending about one of the goal barriers, and each having a constant width defined by the goal barrier and a halt circle. There are two circular free throw lines on the court, each being concentric with one of the barriers and extending around one of the halt zones. Each of the barriers includes one or more video screens on an outer wall facing away from the centerpoint. A computer network, preferably wireless, is configured to control images displayed on the one or more video screens. The wireless network is accessible to electronic devices used by audience members outside the judge lane and allows audience members to project images onto the video screens in real-time as two teams participate in a ball game on the court. A ball used with the game system has a surface texture comprised of square pebbling.

It is therefore an object of the present invention to provide a game played on a courts by two teams in which a ball is attempted to be placed in the opposing team's goal, wherein the outer wall of the goal itself includes one or more display screens that may be manipulated by members of the audience. A ball having a specialized surface texture improves player control of the ball.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
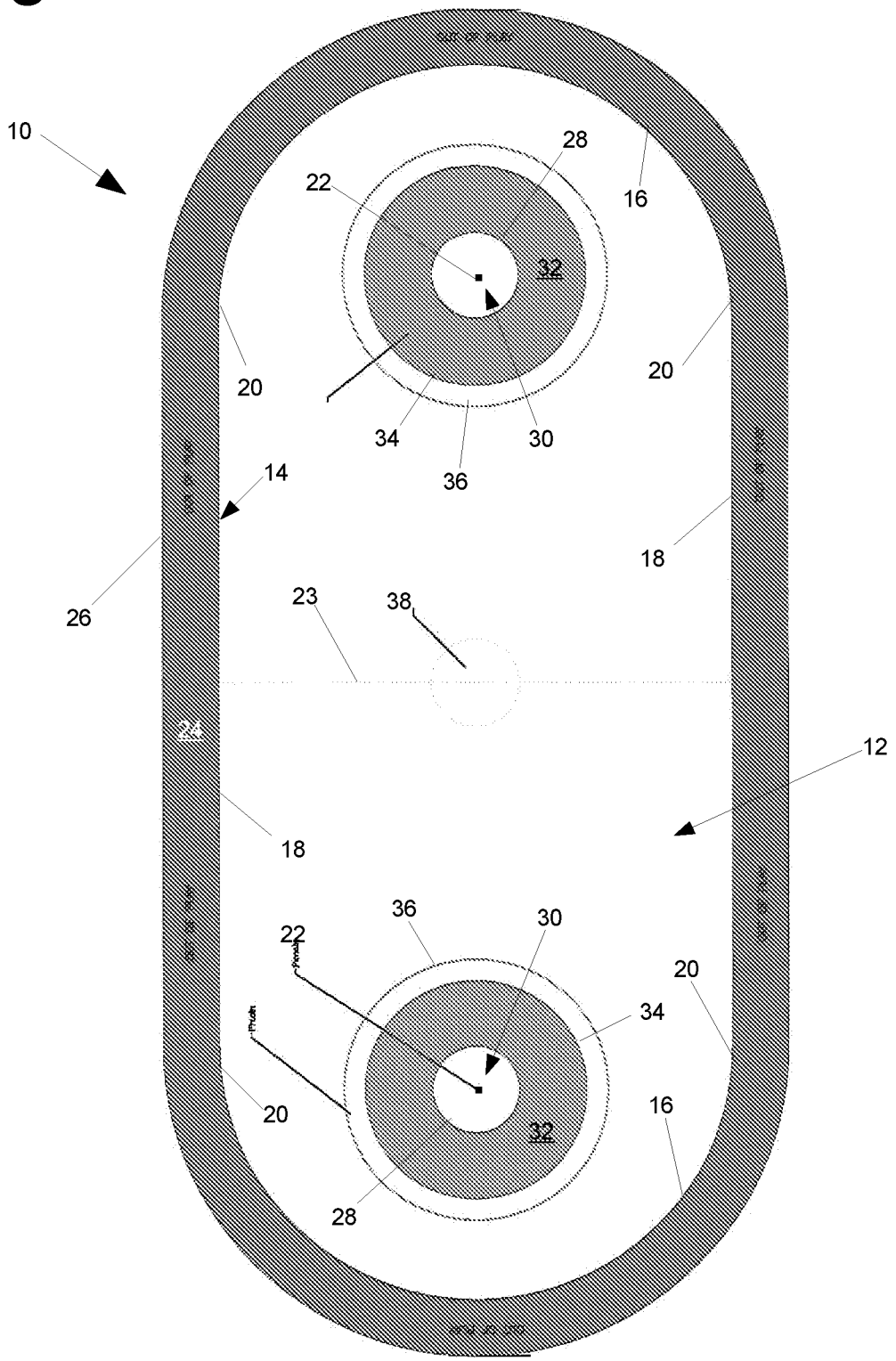
FIG. 1 is a top plan view of a game system in accordance with principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein. Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

Unless otherwise indicated, all numbers expressing quantities of ingredients, dimensions reaction conditions and so forth used in the specification and claims are to be understood as being modified in all instances by the term "about". The term "a" or "an" as used herein means "at least one" unless specified otherwise. In this specification and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

Various embodiments of the disclosure could also include permutations of the various elements recited in the claims as if each dependent claim was a multiple dependent claim incorporating the limitations of each of the preceding dependent claims as well as the independent claims. Unless explicitly stated otherwise, such permutations are expressly within the scope of this disclosure.

Disclosed is a game system played by two teams using a ball having square pebbling, a specialized court and an interactive barrier around the goals. The exemplary barriers described herein all have radial symmetry and are concentric with the semicircles defining the perimeter of the game court as well as other features such as the halt zone and free-throw line. All of the exemplary barriers also include one or more video screens embedded or otherwise incorporated into an outer wall of the barrier. An audience viewing a game being played using the game system described herein may access a computer network over the Internet, wirelessly, or otherwise in order to display static or moving images on the one or more video screens Incorporated into the outer wall of the barrier. The outer wall of the barrier may be cylindrical, frustoconical or have the shape of an inverted concave cone.

FIG. 1 shows a game system 10 having interactive goal barriers. A game system 10 includes an obround court 12 defined by an obround court perimeter 14 formed by two semicircles 16 connected by parallel lines 18 extending tangentially from the opposing endpoints 20 of the semicircles 16. Each semicircle 16 defines a centerpoint 22. An obround judge lane 24 has a constant width which is defined by the court perimeter 14 and a judge perimeter 26. A barrier 28 is centered around each of the two centerpoints 22 and each cylindrical barrier 28 defines a cylindrical goal 30 having a circular opening defined by the upper rim of the barrier 28. In this embodiment, the barriers 28 are cylindrical. Optionally, the barriers may be oval, a tangential polygon concentric about the centerpoint, hexagonal, rectangular or have other shapes.

Each barrier 28 is surrounded by a halt zone 32 defined as the region between the barrier 28 and a halt line 34. In this embodiment, the halt zone 32 is annular. Outside of and surrounding each halt line 34 is a free-throw line 36 which in this embodiment is also circular and concentric to the barrier 28. In this embodiment, the court 10 is divided by a centerline 23 equidistant from the centerpoints 22. A central circle 38 is divided by the centerline 23 and is equidistant from each of the centerpoints 22.

During play of an exemplary game, players for each team attempt to throw a ball into an opposing team's goal, the goals being defined as the cylindrical region inside the cylindrical barriers 28. Players are not allowed to step foot within the halt zone 32. To enforce the rules of this exemplary game, one referee or judge remains inside the court perimeter 14, and two others stay between the court perimeter 14 and the judge perimeter 14.

In one exemplary embodiment, the court 12 has a length defined by the most extreme points of the semicircles 16 which is between 300 to 360 feet long and a width defined by the distance between the two parallel lines 18 which is between 150 and 350 feet wide. The circular barriers 28 may have a diameter of 12 feet. An indoor court may be substantially smaller.

Figure 2:
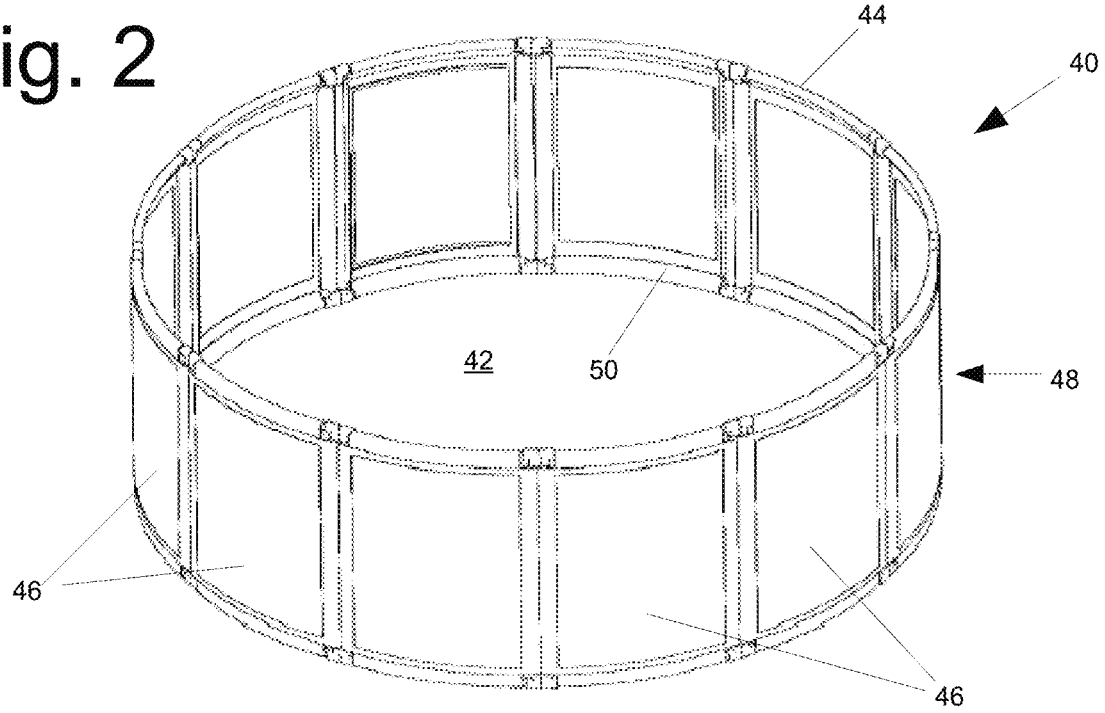
FIG. 2 is a perspective view of a barrier for a game system in accordance with principles of the invention.

FIG. 2 shows a radially symmetric cylindrical barrier 40 defining a cylindrical goal 42 having an opening defined by the upper rim 44 of the barrier 40. In this embodiment, the barrier 40 is made of a plurality of curved panels 46 which form a circular outer wall 48 and are supported by a barrier frame 50. The panels 46 are individual curved video screens facing outward. Optionally, the circular outer wall 48 may be a single circular video screen wrapped around a barrier frame 50. Because the outer wall 48 includes electronic equipment which may be sensitive to impact, the panels 46 of the barrier 40 are constructed with a heavy-duty, durable cover of transparent plastic, polymer, resin or other material capable of protecting LED screens from the impact of balls and/or bodies against the outer wall 48, which may optionally include one or more resilient layers.

Figure 3:
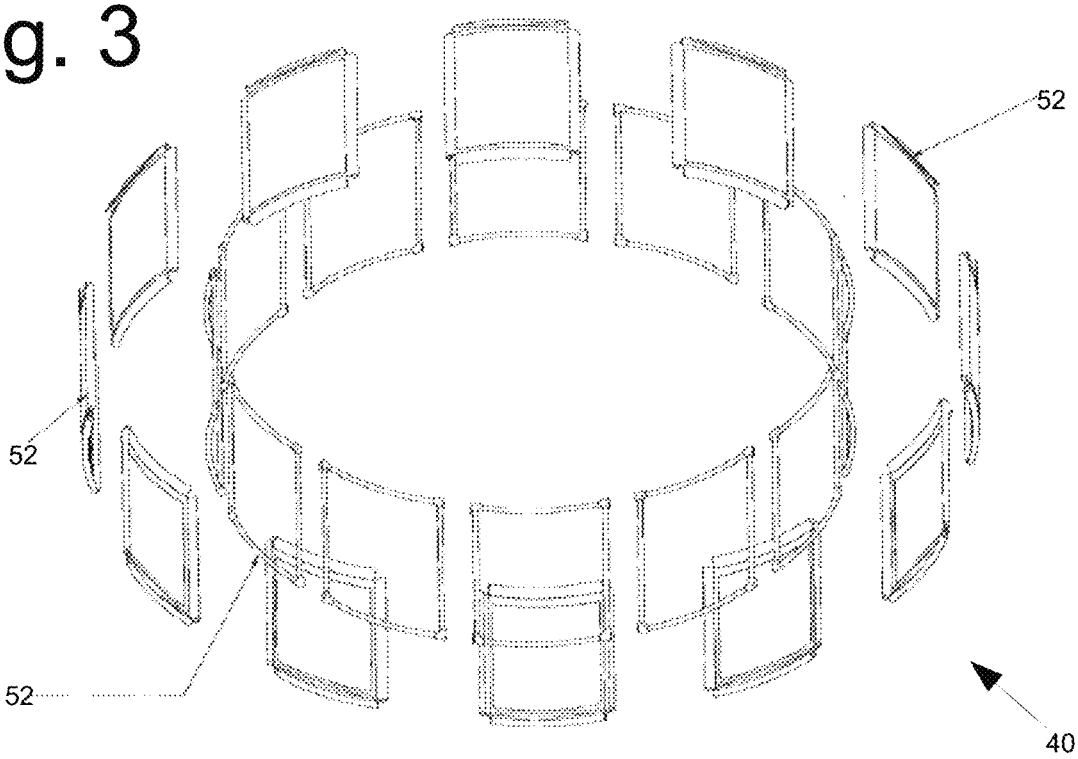
FIG. 3 is a perspective exploded view of a barrier for a game system in accordance with principles of the invention.

FIG. 3 shows an exploded view of the barrier 40 formed from a plurality of panels 46 supported by a modular barrier frame 50. The modular barrier frame 50 is itself formed from a plurality of single curved rectangular frames 52. The barrier 40 is intended to be an example only and those skilled in the art will appreciate that several other suitable methods of constructing a barrier in accordance with principles of the invention.

Figure 4:
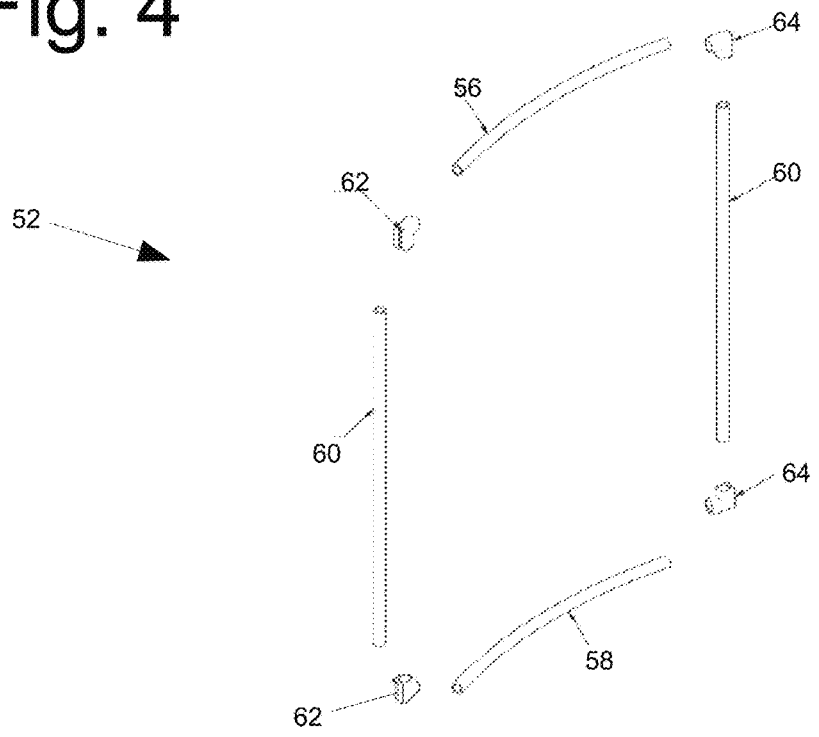
FIG. 4 is a perspective view of a single panel frame of a barrier for a game system in accordance with principles of the invention.
Figure 5:
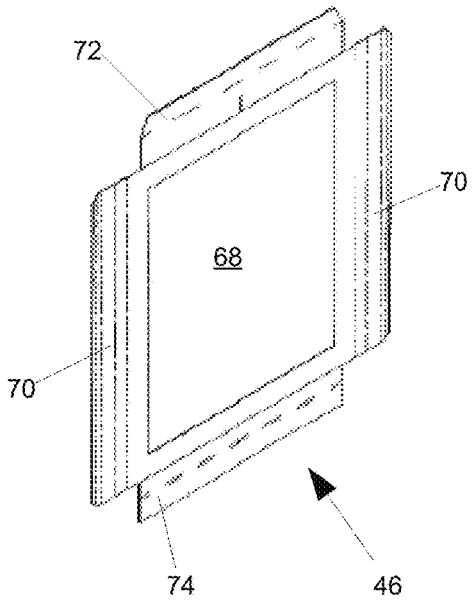
FIG. 5 is a perspective view of a single panel with tabs extended of a barrier for a game system in accordance principles of the invention.
Figure 6:
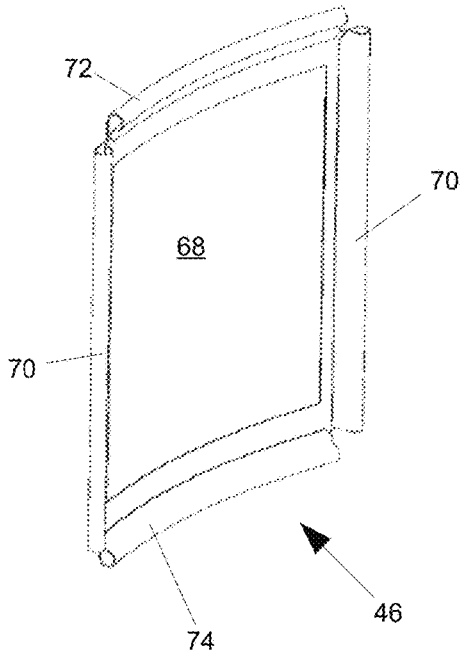
FIG. 6 is a perspective view of a single panel with folded tabs for a game in accordance principles of the invention.

FIG. 4 shows an exploded view of a single panel frame 52 having upper and lower horizontal members 56 and 58, and two lateral members 60. The lateral members 60 are attached to opposite ends of the upper and lower horizontal members 56 and 58 by means of corner members 62 and 64. A panel 46 is shown in FIG. 5 and is composed of a central video screen 68 with two lateral tabs 70 and upper and lower tabs 72 and 74. FIG. 6 shows the lateral tabs 70 and the upper and lower tabs 72 and 74 folded over to form channels through which the members 56, 58 and 60 of the single panel frame 52 may extend, best supporting the panel 46. The tabs 50, 52 and 54 may be attached to themselves when folded over by means of a hook and loop fastening system, a timeline groove, snaps or other mechanisms known in the art.

Figure 7:
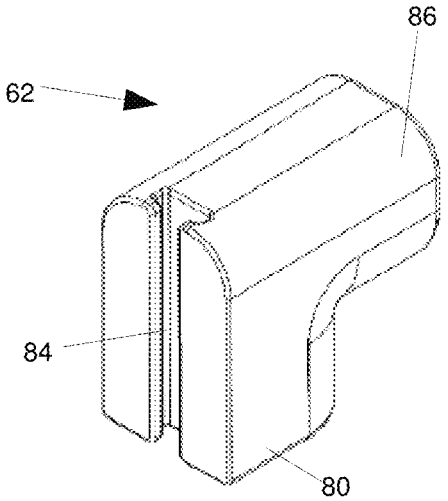
FIG. 7 is a perspective view of a corner member of a single panel frame of a barrier for a game system in accordance with principles of the invention.
Figure 8:
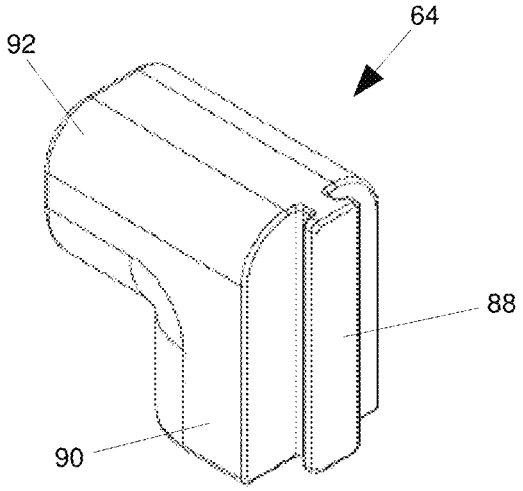
FIG. 8 is a perspective view of complementary corner member of a single panel frame of a barrier for a game system in accordance with principles of the invention.

FIG. 7 shows a corner member 62 designed to attach to lateral members 60 by sliding its vertical socket 80 over the top of the lateral member 60. The corner member 62 attaches to a upper or lower horizontal member 56 or 58 by inserting the member into its horizontal socket 82. The corner member 62 includes a channel 84 complementary to a ridge 88 found on corner member 64. FIG. 8 shows corner member 64 which attaches to lateral members 60 at its vertical socket 90 and attaches to upper and lower horizontal members 56 or 58 by its horizontal socket 92. Single panel frames 52 are connected consecutively by interlocking corner members 62 and 64 of adjacent single panel frames 52. Thus, a plurality of panels 46 may form a single goal barrier 40.

The circular outer wall 48 may be used to display a variety of static and/or fluid images during play. The video screen or screens that make up the outer wall 48 are connected to a computer network. Members of the audience watching a game played on the game system of the invention are able to access the computer network and select images or videos to be displayed on the video screen or screens on the outer wall of the barrier 40. Audience members may upload images to the wireless network and display them on the video screen or screens. Audience members may also choose to display text messages, images, EMOJI's, selected from a group of images provided on the wireless network and supplied by the teams or one or more organizations promoting the game. For example, audience members may display messages to friends or family via the video screen or screens, messages to players on one or more of the teams, messages of support to one of the teams, messages to distract members of one team, or other images or videos allowed by the wireless network. The wireless network may include restrictions to prevent audience members from displaying images or messages having foul language or inappropriate material such as violence and/or nudity. The interactive features allowing audience members to post messages or images on the outer wall of the barrier is not necessarily limited to audience members actually present at the game. Viewers of a televised game may also connect to the wireless network of the game system over the Internet in real time.

Figure 9:
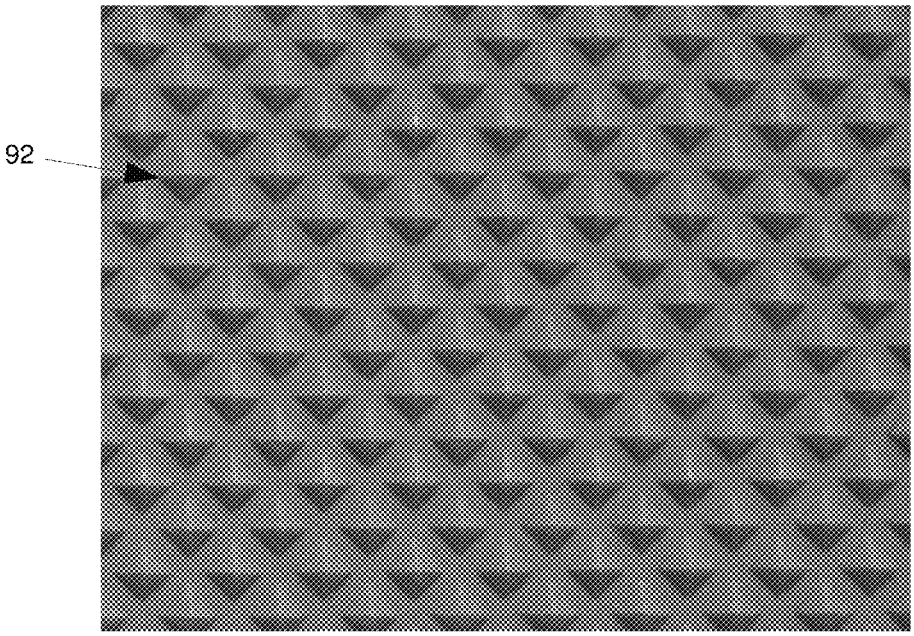
FIG. 9 is a top plan view of a square textured surface of a ball for a game system in accordance with principles of the invention.

The game system of the invention also includes a specialized ball. The game contemplates players passing the ball and manipulating it with their hands. It is therefore preferable to have surface texture on the ball that allows players to grip it securely. Similar balls, such as basketballs typically include a pebbled surface comprised of small circular, rounded bumps across its surface, as shown in FIG. 9. This type of surface texture is commonly used. However, it results in a more randomized direction name of the ball when it is balanced against a flat surface such as a floor. The curved pebbles result in the ball deviated from its intended path by the person bouncing it.

A ball of the present invention utilizes a surface texture comprise of a plurality of squares 92 as shown in FIG. 9. The texture of the ball the present invention bounces off of a surface in a linear fashion, improving control of the ball during play. In addition to the texture shown in FIG. 9, a ball in accordance with principles of the invention has a surface that may be detectable by sensors in the floor of the goal and/or the top of the goal barrier. Those skilled in the art will appreciate that there are several mechanisms for accomplishing this. For example, the surface of the ball may be formed from a conductive material or may have a conductive material interspersed throughout it, such as for example conductive threads dispersed within the polymer from which the surface of the ball is formed. A sensor pad covering the floor of the goal is covered with alternating anodes and cathodes separated by small distances. When the ball contacts the sensor pad, the conductive threads or other conductive aspects of the surface of the ball complete a circuit between one or more anodes and cathodes in the sensor pad. This completes an electric circuit which may be detected, confirming that the ball has made contact with the sensor pad. Similarly, alternating cathodes and anodes separated by small distances may be placed along the top of the goal barrier, or any other location. When the ball makes contact with the top of the goal barrier, it again completes the circuit which may be detected, indicating that the ball has touched the top of the goal barrier. Optionally, pressure sensors can be used to detect when the ball has struck the top of the goal barrier or the floor inside the goal. It may be necessary or preferred to have a goalkeeper wear special shoes that do not actuate the pressure sensors within the goal.

Similarly, sensors in the floor may be utilized to detect when the ball or a person comes in the contact with the floor within the halt zone 32 region shown in FIG. 1, or the perimeter around the court to detect when a ball has left the field of play. Optionally, the sensors may be in wireless communication with foul cards, similar to the cards used in soccer, carried by referees and/or judges. However, the electronic cards in accordance with principles of the invention have video screens on each side. When a player commits a foul, the screens automatically change color to indicate a foul. The electronic cards may optionally vibrate when a foul is committed, to alert the referee or judge. The referee or judge will then know to present the card to the player who committed the foul.

Figure 10:
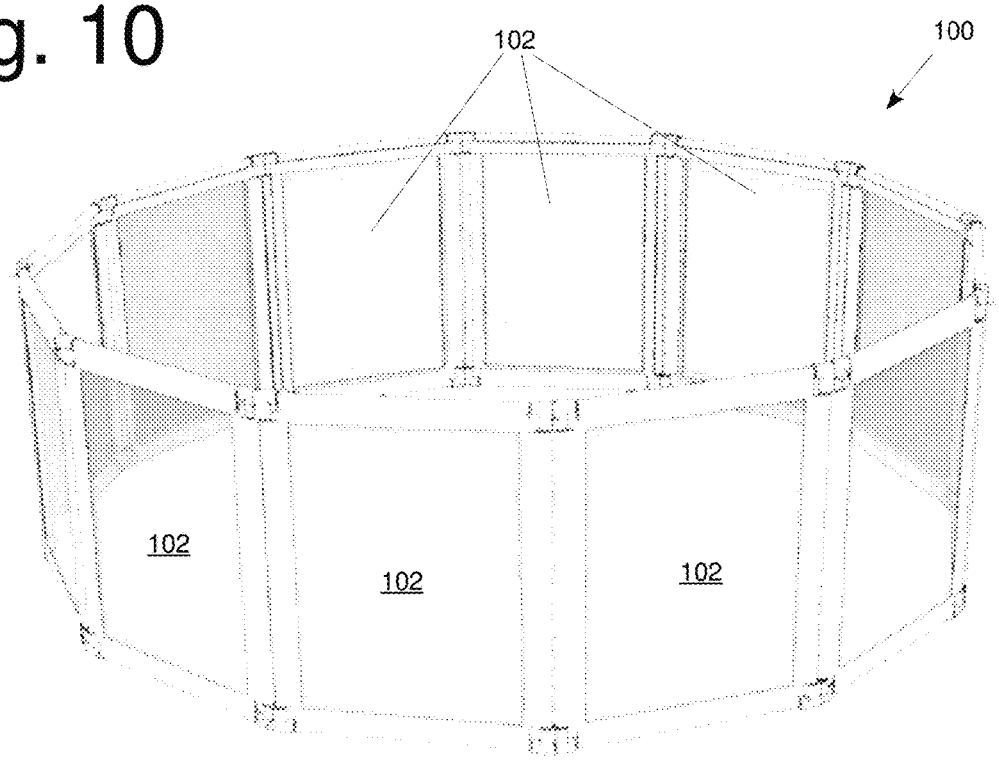
FIG. 10 is an alternative embodiment of a barrier for a game system in accordance with the principles of the invention.

FIG. 10 shows an alternative embodiment of a radially symmetric barrier 100 comprised of several flat panels 102. In this embodiment, the barrier 100 and has a tangential polygon shape defining a goal inside of. Each panel 102 includes a semi-transparent video screen that can operate in conjunction with other screens or independently.

Figure 11:
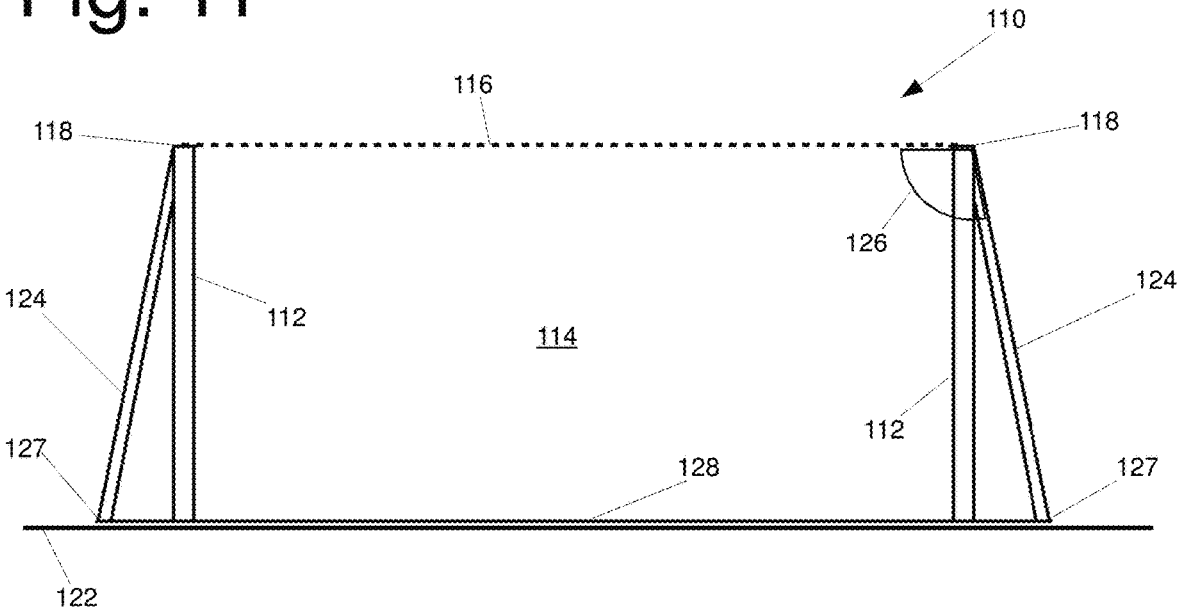
FIG. 11 is a cross-sectional view of another alternative embodiment of a barrier for a game system in accordance with the principles of the invention.

FIG. 11 shows a cross-section of an alternative embodiment of a radially symmetric barrier 110 in accordance with principles of the invention. In this embodiment, the barrier 110 has an inner wall 112 defining a cylindrical goal 114 having a circular, planar opening 116 defined by the rim 118 of the barrier 110 and which is parallel to the ground 122 and perpendicular to the inner wall 112. The outer wall 124 of the barrier 110 has a frustoconical shape and forms an obtuse angle 126 with the opening 116. The outer wall 124 extends downward from the rim 118 tapering outward to the circumference 127 the circular base 128 of the barrier 110, which is wider than the circular, planar opening 116 of the goal 114. As explained above, a barrier 110 may be impacted several times during gameplay by a ball and/or players bodies. The wider base 128 provides greater stability for the barrier 110. The angled outer wall 124 also causes a ball bouncing off the outer wall to be deflected partially upward and away from the surface on which the barrier 110 is placed and over which a game is being played. The frustoconical shape of the outer wall 124 also causes the force of impacts with balls and players against the barrier 110 to be partially directed downward into the ground. A perfectly cylindrical barrier requires the force of an impact to be almost entirely absorbed by the barrier itself. Redirecting the force partially into the ground reduces the force absorbed by the barrier 110, serving to better protect video screens located on the outer wall 124.

Figure 12:
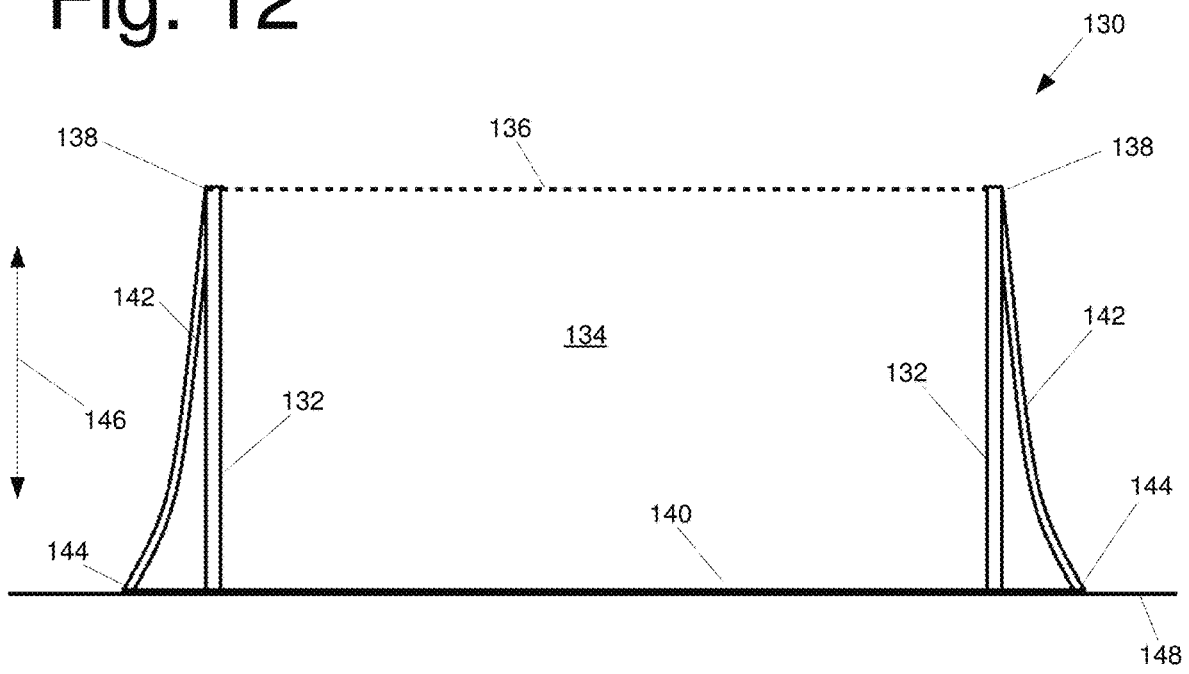
FIG. 12 is a cross-sectional view of another alternative embodiment of a barrier for a game system in accordance with principles of the invention.
Figure 13:
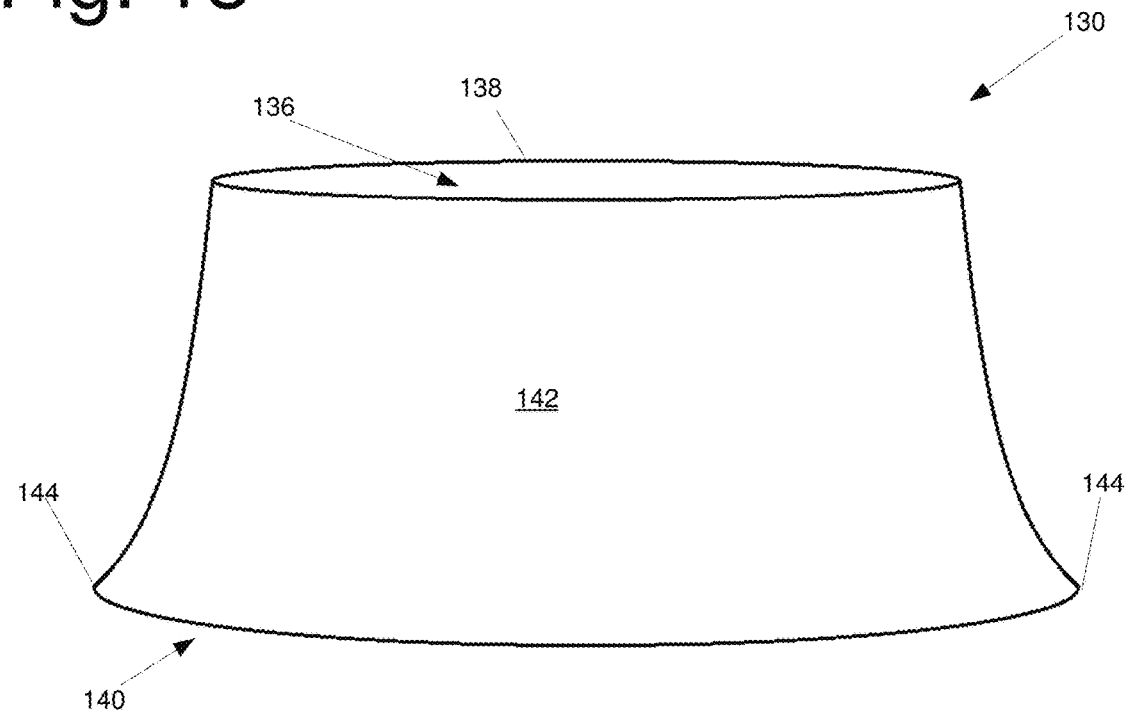
FIG. 13 is a perspective view of another alternative embodiment of a barrier for a game system in accordance with principles of the invention.

FIGS. 12 and 13 show another alternative embodiment of a radially symmetric barrier 130 in accordance with the principles of the invention. Barrier 130 has an inner wall 132 defining a cylindrical goal 134 having a circular, planar opening 136 defined by the rim 138 of the barrier 130. The planar opening 136 is perpendicular to the inner wall 132 and parallel to the base 140. The outer wall 142 tapers outward from the rim 138 to the circumference 144 of the base 140. In this embodiment, the outer wall 142 is concave in the vertical direction 146. For the same reasons described above in reference to the barrier 110, the barrier 130 is more stable than a barrier having a cylindrical outer wall and directs impact forces partially into the ground 148 on which the base 140 rests. In addition, the concave curvature of the outer wall 142 enhances the visual effects of rotating an image around the outer wall during play. Images or portions of images close to the base 140 of the barrier 130 travel faster around the outer wall but still remain parallel to images or portions of images directly above the image near the base 140. Audience members favoring one of the teams may therefore display images rotating around the favored team's goal that are more likely to distract players of an opposing team attempting to throw a ball into the favored team's goal.

The use of interactive screens that allow an audience to select images projected on the screens may be applied to more than the game described in accordance with principles of the invention. Viewing screens anywhere, in front of stores, on build the, in public places, and lobbies and reception areas, or anywhere else for the person may desire to install a monitor, television or other viewing screen, may be connected to a wireless network that allows a person using a cell phone, laptop, computer or other device to display images of their choosing on the screen. The ability to connect with the wireless network and/or control the images on viewing screens may be regulated so that only persons having a correct subscription, password, software application, or other limiting characteristic have the ability to post messages on the screen.

Whereas, the present invention has been described in relation to the drawings attached hereto, other and further modifications, apart from those shown or suggested herein, may be made within the spirit and scope of this invention. Those skilled in the art will appreciate that the conception, upon which this disclosure is based, may readily be utilized as a basis for the designing of other structures, methods and systems for carrying out the several purposes of the present invention. Descriptions of the embodiments shown in the drawings should not be construed as limiting or defining the ordinary and plain meanings of the terms of the claims unless such is explicitly indicated. The claims should be regarded as including such equivalent constructions insofar as they do not depart from the spirit and scope of the present invention.

The invention claimed is:

1. A team ball game system having interactive goal barriers comprising:

an obround court defined by a court perimeter formed from two semicircles connected by two parallel lines tangent to opposing endpoints of the semicircles, each semicircle defining a centerpoint equidistant from every point of the defining semicircle;

an obround judge lane extending about the perimeter of the obround court and having a constant width defined by the court perimeter and a judge lane perimeter;

two radially symmetric goal barriers on the court, each being concentric to one of the semicircles of the court perimeter;

two goals, each defined as a cylindrical space inside one of the goal barriers, each goal having a circular opening defined by an upper rim of one of the two radially symmetric goal barriers;

two annular halt zones on the court, each being concentric to and extending about one of the goal barriers, and each having a constant width defined by the goal barrier and a halt circle;

two circular free throw lines on the court, each being concentric with one of the goal barriers and extending around one of the halt zones;

wherein each of the goal barriers includes one or more video screens on an outer wall facing away from the centerpoint; and a wireless network configured to control images displayed on the one or more video screens;

wherein the wireless network is accessible to electronic devices used by audience members outside the judge lane and allows audience members to project images onto the video screens in real-time as two teams participate in a ball game on the court; and, wherein the outer wall of the radially symmetric goal barriers extends downward from the rim to a circumference of a base, wherein the base is larger than the rim and the outer wall is concave in a vertical direction.

* * * * *